United States Patent [19]

Collins et al.

[11] Patent Number: 4,541,556

[45] Date of Patent: Sep. 17, 1985

[54] POSITIVE DELIVERY KNIFE SHEATH

[75] Inventors: Walter W. Collins, North, S.C.; Jonathan P. Reinschreiber, Gastonia, N.C.

[73] Assignee: Gerber Legendary Blades, Portland, Oreg.

[21] Appl. No.: 593,707

[22] Filed: Mar. 26, 1984

[51] Int. Cl.[4] ..... B26B 29/02

[52] U.S. Cl. ..... 224/196; 224/232; 206/250

[58] Field of Search ..... 30/151; 224/232, 234, 224/253, 196; 206/249, 3, 37, 254, 250, 256

[56] References Cited

U.S. PATENT DOCUMENTS 3,212,689 10/1965 Woolfolk ..... 224/196

3,589,505 6/1971 Burniski ..... 206/250

*Primary Examiner*—Stephen Marcus

*Assistant Examiner*—David Voorhees

*Attorney, Agent, or Firm*—Clifton Ted Hunt

[57] ABSTRACT

A positive delivery sheath for a knife of the type having a handle and a blade housed within the handle when not in use, and a flexible strap connected at one end to the sheath and normally encircling the knife within the sheath to protect the knife against accidental removal, and the strap being extensible to positively deliver the knife from the sheath when desired.

5 Claims, 3 Drawing Figures

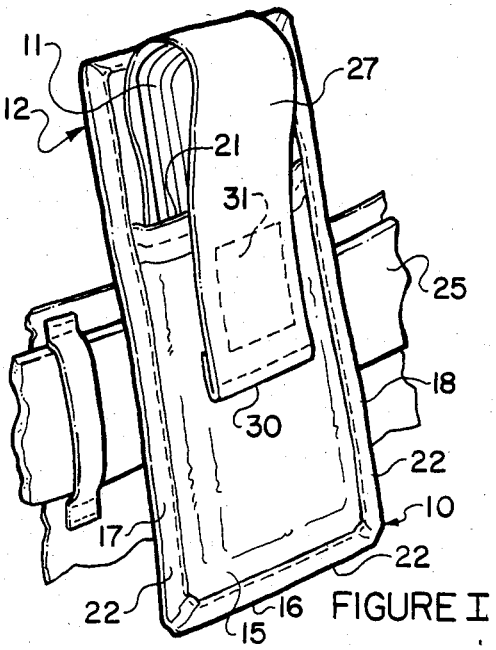
FIGURE I
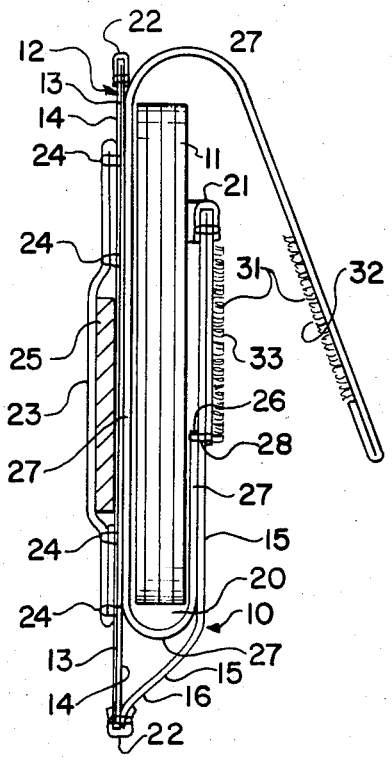
FIGURE II
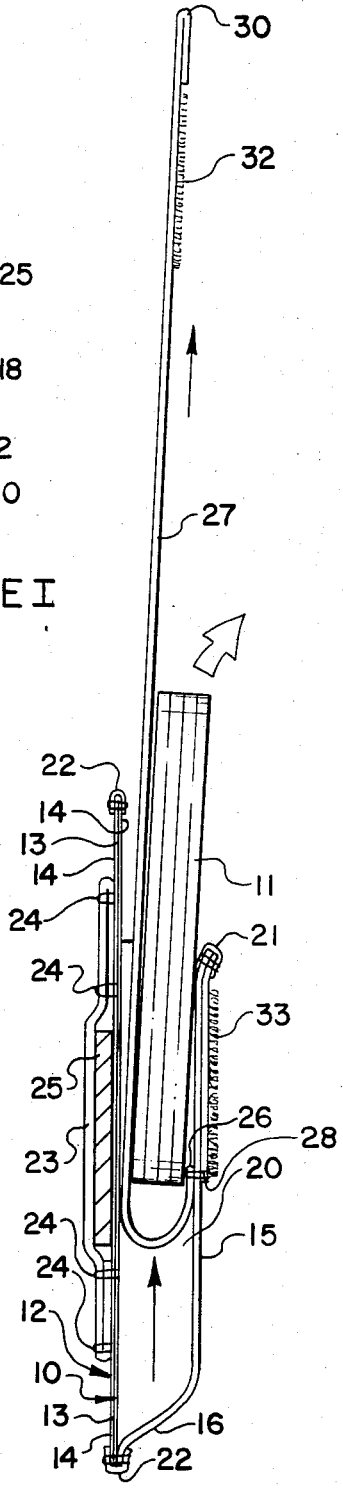
FIGURE III

POSITIVE DELIVERY KNIFE SHEATH

BACKGROUND OF THE INVENTION

One form of a positive delivery knife sheath is shown in U.S. Pat. No. 3,841,541 issued Oct. 15, 1974 to William T. Griffis. Griffis discloses a hunting knife having a blade and a handle enclosed within an outer sheath of sufficient length to cover both the blade and the handle to prevent the knife from being accidently removed from the sheath. An inner sheath extends about the blade of the knife and a thong is attached to the inner sheath and extends through a longitudinally extending slot in the outer sheath. The thong is pulled along the slot to move the handle beyond the outer sheath when it is desired to remove the knife from the sheath.

U.S. Pat. No. 1,388,073 issued Aug. 16, 1921 to N. G. Stewart discloses a cigarette case including a flap foldable over the top of a pack of cigarettes. A ribbon has one end secured to the inner front wall of the case and its other end secured to the inner face of the flap. The ribbon is long enough to extend around a pack of cigarettes and the pack of cigarettes can be drawn from the pocket by pulling on the end of the ribbon attached to the inner face of the flap.

A similar construction is shown in U.S. Pat. No. 3,212,689 to Woolfolk, except that the ribbon or retractor strip is not attached to the flap in Woolfolk.

Thus, in both Stewart and Woolfolk it is necessary to perform two steps prior to actual removal of the contents of the case; (1) raise the flap, and (2) manipulate the ribbon or retractor strip to elevate the contents of the case into position to be grasped. Similarly, two steps are necessary in Griffis. First, the thong must be manipulated to present the handle of the knife beyond the outer sheath and then the handle must be grasped to remove the blade from the inner sheath.

According to the present invention, only one motion is required to simultaneously remove the cover from the knife and positively present the knife for grasping and removal from the sheath.

SUMMARY OF THE INVENTION

The sheath of the present invention is intended to house a pocket knife wherein the blade is normally housed within the handle of the knife when not in use. The sheath includes a back wall extending the length of the knife handle and a front wall sewn along its sides and one end to the back wall to define a U-shaped pocket for reception of the knife. The front wall is shorter than the back wall so that a portion of the knife extends above the front wall when the knife is fully seated in the pocket of the sheath.

It is an object of the invention to provide a sheath of the type described and including a protective strap normally overlying the knife in the sheath to protect it, and said strap extending about the knife and being extensible to deliver the knife from the sheath in a single motion.

BRIEF DESCRIPTION OF THE DRAWINGS

FIG. 1 is a perspective view of the sheath and knife supported on a person's belt;

FIG. 2 is a sectional view showing the knife within the sheath and the strap extending about and protectively folded over the knife; and FIG. 3 is a sectional view similar to FIG. 2 but showing the strap in extended position after delivering the knife outwardly of the sheath.

DETAILED DESCRIPTION OF THE INVENTION

Referring more specifically to the drawings, reference numeral 10 broadly indicates a sheath for a knife 11 of the type with the blade normally housed within the handle when not in use.

The sheath 10 includes a stiffened back wall 12 comprising a rectangular sheet of thin rigid material 13, such as plastic and covered by fabric 14. A front wall 15 is formed of fabric and sewn to the rear wall 12 along one end 16 and the sides 17 and 18 to form a pocket 20 between the rear wall 12 and front wall 15 for reception of the knife 11. The rear wall 12 is of a length sufficient to extend beyond the knife 11 when the knife 11 is fully seated in the pocket 20 while the front wall 15 is shortened so that the knife 11 projects above the top edge 21 of front wall 15 when the knife 11 is fully seated in the pocket 20. The sewn edges of the back 12 and front wall 15 are covered by a tape 22. A mounting strap 23 is sewn as at 24 to the outer surface of the back wall 12 to receive a belt 25 extending about a person's waist.

One end 26 of a strap 27 is sewn as at 28 to the inner surface of the front wall 15. As most clearly seen in FIG. 2, the strap 27 is of sufficient length to extend completely around the knife 11 and does, in fact, extend inwardly toward the end 16 along the inner surface of front wall 15 and outwardly along the inner surface of rear wall 12, over the knife 11 and into overlapping relation with the outer surface of front wall 15. The free end portion 30 of strap 27 is releasably attached to the outer surface of front wall 15 by a hook and loop fastener 31, one component of which is attached to the inner surface of the strap 27 as at 32 and the other component of which is attached to the outer surface of front wall 15 as at 33.

The strap 27 is formed of a flexible web fabric of a width approximately equal to the width of the knife 11 and less than the width of the pocket 20. The inner fixed end 26 of strap 27 remains at all times fastened to the medial portion of the inner surface of front wall 15 and the flexible strap 27 is folded about the inner end of knife 11 as the knife 11 is positioned in the pocket 20 (FIG. 2). In that position the fastener 31 is engaged to lock the strap 27 about the knife 11 and protectively enclose the knife 11 within the pocket 20.

When it is desired to remove the knife 11 from the pocket 30, the free end 30 of the strap 27 is grasped and the strap 27 is extended to the position of FIG. 3 which, in one motion, releases the fastener 31 and delivers the knife 11 from the sheath 10 (FIG. 3). The juncture of the strap 27 with the front wall 15 at 28 is so positioned as to leave the lower portion of the knife 11 within the pocket 20 when the strap 27 is fully extended to the position of FIG. 3. This has the advantage of enabling the user to retain control over the knife instead of having the knife thrown bodily from the pocket. The knife may be readily grasped and removed when in the delivered position of FIG. 3.

Although specific terms have been used in describing the invention, they are used in a generic and descriptive sense only and not for purposes of limitation.

We claim:

1. A positive delivery knife sheath comprising a back wall and a front wall interconnected at their sides and lower ends to define a pocket having an open end opposite the lower end for reception of a knife, a flexible strap including a free end and a fixed end, the fixed end being positioned within the pocket and fastened to the inner surface of the front wall at a point intermediate the open end of the pocket and its lower end, said flexible strap extending downwardly along the front wall from the juncture of its free end with the front wall, across the lower end of the pocket, upwardly along the back wall, forwardly across the said open end of the pocket and downwardly along the outer surface of the front wall, and means for releasably connecting the free end of the flexible strap to the outer surface of the front wall at variable points spaced vertically from each other along the outer surface of the front wall, whereby the free end of the flexible strap may be disconnected from the front wall and the strap moved to open the pocket for reception of a knife within the pocket and engagable with that portion of the flexible strap at the lower end of the pocket, after which the flexible strap may be positioned across the pocket above the knife and the free end of the flexible strap connected to the outer surface of the front wall at a selected point depending on the length of the knife, and whereby the subsequent disconnection of the free end of the strap from the front wall and movement of the strap to open the pocket will positively deliver the knife from the sheath.

2. A structure according to claim 1 wherein the back wall of the sheath is of a length sufficient to extend beyond the knife when the knife is fully seated in the pocket, and wherein the front wall is shortened so the knife extends beyond the front wall when the knife is fully seated in the pocket.

3. A structure according to claim 2 wherein the rear wall is stiffened.

4. A structure according to claim 2 wherein the means releasably attaching the strap to the sheath comprises a hook and loop fastener with one component attached to the outer surface of the front wall and one component attached to a surface on the free end portion of the strap.

5. A structure according to claim 1 wherein a mounting strap is provided on the back wall of the sheath for the reception of a belt extending about a person's waist.

* * * * *